US011854760B2

(12) United States Patent
Wright et al.

(10) Patent No.: US 11,854,760 B2
(45) Date of Patent: Dec. 26, 2023

(54) CRUCIBLE DESIGN FOR LIQUID METAL IN AN ION SOURCE

(71) Applicant: Applied Materials, Inc., Santa Clara, CA (US)

(72) Inventors: Graham Wright, Newburyport, MA (US); Eric Donald Wilson, Rockport, MA (US); Daniel Alvarado, Methuen, MA (US); Robert C. Lindberg, Rockport, MA (US); Jacob Mullin, North Andover, MA (US)

(73) Assignee: Applied Materials, Inc., Santa Clara, CA (US)

( * ) Notice: Subject to any disclaimer, the term of this patent is extended or adjusted under 35 U.S.C. 154(b) by 331 days.

(21) Appl. No.: 17/353,171

(22) Filed: Jun. 21, 2021

(65) Prior Publication Data

US 2022/0406554 A1 Dec. 22, 2022

(51) Int. Cl.
*H01J 27/02* (2006.01)
*H01J 27/14* (2006.01)

(52) U.S. Cl.
CPC ..... *H01J 27/022* (2013.01); *H01J 27/14* (2013.01)

(58) Field of Classification Search
CPC ..... H01J 27/022; H01J 27/14
See application file for complete search history.

(56) References Cited

U.S. PATENT DOCUMENTS 3,404,084 A 10/1968 Hamilton
4,061,800 A 12/1977 Anderson
4,152,478 A 5/1979 Takagi
4,631,448 A 12/1986 Tamura et al.
4,680,507 A 7/1987 Uemura et al.
5,089,746 A 2/1992 Rosenblum et al.
5,180,477 A 1/1993 Ito
(Continued)

FOREIGN PATENT DOCUMENTS

CN 1086853 A 5/1994
CN 1383179 A 12/2002
(Continued)

OTHER PUBLICATIONS

International Search Report and Written Opinion dated Mar. 5, 2019 in co-pending PCT application No. PCT/US2018/061000.
(Continued)

*Primary Examiner* — Joseph L Williams
(74) *Attorney, Agent, or Firm* — NIELDS, LEMACK & FRAME, LLC.

(57) ABSTRACT

A crucible that exploits the observation that molten metal tends to flow toward the hottest regions is disclosed. The crucible includes an interior in which dopant material may be disposed. The crucible has a pathway leading from the interior toward an aperture, wherein the temperature is continuously increasing along the pathway. The aperture may be disposed in or near the interior of the arc chamber of an ion source. The liquid metal flows along the pathway toward the arc chamber, where it is vaporized and then ionized. By controlling the flow rate of the pathway, spillage may be reduced. In another embodiment, an inverted crucible is disclosed. The inverted crucible comprises a closed end in communication with the interior of the ion source, so that the closed end is the hottest region of the crucible. An opening is disposed on a different wall to allow vapor to exit the crucible.

20 Claims, 6 Drawing Sheets

(56) References Cited

U.S. PATENT DOCUMENTS

| | | | |
|---|---|---|---|
| 5,733,418 | A | 3/1998 | Hershcovitch et al. |
| 5,922,179 | A | 7/1999 | Mitro et al. |
| 5,977,552 | A | 11/1999 | Foad |
| 6,048,813 | A | 4/2000 | Hunter |
| 6,156,172 | A | 12/2000 | Kadokura |
| 6,682,634 | B1 | 1/2004 | Kahn et al. |
| 6,768,121 | B2 | 7/2004 | Horsky et al. |
| 7,655,932 | B2 | 2/2010 | Hatem et al. |
| 7,820,981 | B2 | 10/2010 | Horsky et al. |
| 7,838,850 | B2 | 11/2010 | Hahto et al. |
| 8,324,592 | B2 | 12/2012 | Ryding et al. |
| 8,679,307 | B2 | 3/2014 | Fischione et al. |
| 8,759,788 | B1 | 6/2014 | Bassom |
| 8,809,800 | B2 | 8/2014 | Koo et al. |
| 9,287,079 | B2 | 3/2016 | Chaney et al. |
| 9,396,902 | B2 | 7/2016 | Biloiu et al. |
| 10,014,164 | B2 | 7/2018 | Druz et al. |
| 10,600,611 | B2 | 3/2020 | Becker et al. |
| 10,957,509 | B1 | 3/2021 | Wright et al. |
| 11,170,967 | B2 | 11/2021 | Bassom et al. |
| 11,170,973 | B2 | 11/2021 | Patel et al. |
| 11,404,254 | B2 | 8/2022 | Patel et al. |
| 2002/0130270 | A1 | 9/2002 | Reyes |
| 2002/0153493 | A1 | 10/2002 | Miyabayashi |
| 2003/0125191 | A1 | 7/2003 | Kim et al. |
| 2004/0118452 | A1 | 6/2004 | Sohn et al. |
| 2004/0188631 | A1 | 9/2004 | Horsky et al. |
| 2006/0097645 | A1 | 5/2006 | Horsky |
| 2006/0163489 | A1 | 7/2006 | Low et al. |
| 2007/0158188 | A1 | 7/2007 | Ivanov |
| 2007/0281081 | A1 | 12/2007 | Nakamura et al. |
| 2008/0169427 | A1 | 7/2008 | Hatem et al. |
| 2009/0183679 | A1 | 7/2009 | McIntyre et al. |
| 2009/0289197 | A1 | 11/2009 | Slocum et al. |
| 2009/0309041 | A1 | 12/2009 | Kurunczi et al. |
| 2010/0148088 | A1 | 6/2010 | Radovanov et al. |
| 2012/0048723 | A1 | 3/2012 | Chaney |
| 2012/0104273 | A1 | 5/2012 | Ryding et al. |
| 2012/0255490 | A1 | 10/2012 | Tanjo |
| 2013/0072088 | A1 | 3/2013 | Schneider |
| 2013/0260544 | A1 | 10/2013 | Koo et al. |
| 2013/0313971 | A1 | 11/2013 | Biloiu et al. |
| 2014/0061033 | A1 | 3/2014 | Biskeborn et al. |
| 2014/0238637 | A1 | 8/2014 | Tanaka |
| 2014/0319369 | A1 | 10/2014 | Koo et al. |
| 2015/0034837 | A1 | 2/2015 | Koo et al. |
| 2015/0047079 | A1 | 2/2015 | Kozakai et al. |
| 2017/0140898 | A1 | 5/2017 | Kawaguchi |
| 2017/0247789 | A1 | 8/2017 | Yarmolich |
| 2018/0005793 | A1 | 1/2018 | Chaney et al. |
| 2019/0180971 | A1 | 6/2019 | Becker et al. |
| 2020/0090916 | A1 | 3/2020 | Patel et al. |
| 2021/0110995 | A1 | 4/2021 | Patel et al. |
| 2021/0375585 | A1 | 12/2021 | Patel et al. |
| 2023/0260745 | A1 | 8/2023 | Patel et al. |

FOREIGN PATENT DOCUMENTS

| | | | |
|---|---|---|---|
| CN | 1429793 | A | 7/2003 |
| CN | 1946868 | A | 4/2007 |
| CN | 105390355 | A | 3/2016 |
| CN | 107045971 | A | 8/2017 |
| JP | 4-28862 | A | 1/1992 |
| JP | 5-54809 | A | 3/1993 |
| JP | 5-117843 | A | 5/1993 |
| JP | 5-174762 | A | 7/1993 |
| JP | 9-55169 | A | 2/1997 |
| JP | 9-161702 | A | 6/1997 |
| JP | 2002-93333 | A | 3/2002 |
| JP | 2003-323850 | A | 11/2003 |
| JP | 2004-359985 | A | 12/2004 |
| JP | 2006-70351 | A | 3/2006 |
| JP | 2010-111884 | A | 5/2010 |
| JP | 2011-525036 | A | 9/2011 |
| JP | 2012-1764 | A | 1/2012 |
| JP | 2012-221629 | A | 11/2012 |
| JP | 2013-536561 | A | 9/2013 |
| JP | 2015-512558 | A | 4/2015 |
| JP | 2017-532744 | A | 11/2017 |
| JP | 2018-59134 | A | 4/2018 |
| KR | 10-0793366 | B1 | 1/2008 |
| KR | 2011-0139575 | A | 12/2011 |
| KR | 10-1144222 | B1 | 5/2012 |
| KR | 10-1209107 | B1 | 12/2012 |
| KR | 10-1638443 | B1 | 7/2016 |
| KR | 10-2018-0073766 | A | 7/2018 |
| TW | 200733243 | A | 9/2007 |
| TW | 200835398 | A | 8/2008 |
| TW | 201225149 | A | 6/2012 |
| TW | I413149 | B | 10/2013 |
| TW | 201349342 | A | 12/2013 |
| TW | I517200 | B | 1/2016 |
| TW | I602239 | B | 10/2017 |
| TW | 201937521 | A | 9/2019 |
| TW | 202119452 | A | 5/2021 |
| WO | 2006/100487 | A1 | 9/2006 |
| WO | 2009/088770 | A1 | 7/2009 |
| WO | 2013/148463 | A1 | 10/2013 |
| WO | 2014/179585 | A1 | 11/2014 |
| WO | 2015/017635 | A1 | 2/2015 |
| WO | 2016/061057 | A1 | 4/2016 |
| WO | 2019/118120 | A1 | 6/2019 |

OTHER PUBLICATIONS

International Search Report and Written Opinion dated Nov. 19, 2019 in co-pending PCT application No. PCT/US2019/045052.

International Search Report and Written Opinion dated Dec. 30, 2020 in co-pending PCT application No. PCT/US2020/050857.

International Search Report and Written Opinion dated Feb. 2, 2021 in co-pending PCT application No. PCT/US2020/056802.

Office action dated Mar. 23, 2021 in co-pending U.S. Appl. No. 16/269,120.

Office action dated May 14, 2021 in co-pending U.S. Appl. No. 16/269,120.

Office action dated Feb. 17, 2021 in co-pending U.S. Appl. No. 16/735,125.

Notice of allowance dated Jun. 10, 2021 in co-pending U.S. Appl. No. 16/735,125.

Office action dated Dec. 20, 2022 in co-pending U.S. Appl. No. 17/403,223.

Office action dated Nov. 9, 2021 in co-pending U.S. Appl. No. 16/269,120.

Notice of Allowance dated Mar. 23, 2023 in co-pending U.S. Appl. No. 17/403,223.

International Search Report and Written Opinion dated Sep. 8, 2022 in corresponding PCT application No. PCT/US2022/029784.

Notice of allowance dated Mar. 8, 2022 in co-pending U.S. Appl. No. 16/269,120.

CRUCIBLE DESIGN FOR LIQUID METAL IN AN ION SOURCE

FIELD

Embodiments of the present disclosure relate to a crucible design and more particularly, a crucible for use with metals in an ion source.

BACKGROUND

Various types of ion sources may be used to create the ions that are used in semiconductor processing equipment. For example, an indirectly heated cathode (IHC) ion source operates by supplying a current to a filament disposed behind a cathode. The filament emits thermionic electrons, which are accelerated toward and heat the cathode, in turn causing the cathode to emit electrons into the arc chamber of the ion source. The cathode is disposed at one end of an arc chamber. A repeller is typically disposed on the end of the arc chamber opposite the cathode. The cathode and repeller may be biased so as to repel the electrons, directing them back toward the center of the arc chamber. In some embodiments, a magnetic field is used to further confine the electrons within the arc chamber.

In certain embodiments, it may be desirable to utilize a feed material that is in solid form as a dopant species. For example, the solid feed material may serve as a sputter target. Ions strike the solid feed material, emitting neutrals of the feed material, which can then be ionized and energized in a plasma and used for deposition or implantation. However, there are issues associated with using solid feed materials. For example, in the high-temperature environment of an IHC ion source, metal sputter targets are prone to melting, dripping, and generally degrading and destroying the arc chamber as liquid metal runs and pools in the arc chamber. As a result, ceramics that contain the dopant of interest are commonly used as the solid dopant material, because they have higher melt temperatures. However, these ceramic materials typically generate less beam current of the dopant of interest. If the metal sputter target could maintain its shape without dripping or deformation upon melting, significant increases in dopant beam current could be realized.

Therefore, an advanced crucible design that may be used within an ion source without these limitations would be beneficial.

SUMMARY

A crucible that exploits the observation that molten metal tends to flow toward the hottest regions is disclosed. The crucible includes an interior in which dopant material may be disposed. The crucible has a pathway leading from the interior toward a crucible aperture, wherein the temperature is continuously increasing along the pathway. The crucible aperture may be disposed in or near the interior of the arc chamber of an ion source. The liquid metal flows along the pathway toward the arc chamber, where it is vaporized and then ionized. By controlling the flow rate of the pathway, spillage may be reduced. In another embodiment, an inverted crucible is disclosed. The inverted crucible comprises a closed end in communication with the interior of the ion source, so that the closed end is the hottest region of the crucible. A crucible opening is disposed on a different wall at a lower temperature to allow vapor to exit the crucible.

According to one embodiment, an ion source for generating an ion beam comprising a metal is disclosed. The ion source comprises an arc chamber having an interior for containing a plasma and an extraction aperture for extracting the ion beam; and a crucible having a crucible aperture in communication with the interior of the arc chamber, wherein the crucible comprises a pathway from an interior of the crucible toward the interior of the arc chamber wherein a temperature is continuously increasing along the pathway. In some embodiments, the pathway extends into the interior of the arc chamber. In certain embodiments, the metal comprises aluminum, gallium, lanthanum or indium. In some embodiments, the pathway comprises a wicking rod, having a first end disposed in the interior of the crucible and a tip proximate the crucible aperture. In some embodiments, the pathway comprises a hollow tube.

According to another embodiment, an ion source for generating an ion beam comprising a metal is disclosed. The ion source comprises an arc chamber having an interior for containing a plasma and an extraction aperture for extracting the ion beam; a crucible having a crucible aperture in communication with the interior of the arc chamber; and a wicking rod, having a first end disposed in an interior of the crucible and a tip proximate the crucible aperture. In certain embodiments, the tip extends beyond the crucible aperture and into the interior of the arc chamber. In some embodiments, the first end of the wicking rod is affixed to a back wall of the crucible. In some embodiments, the ion source comprises a porous material disposed in the interior of the crucible and before the crucible aperture, wherein the porous material has an opening through which the wicking rod passes. In certain embodiments, the wicking rod comprises a straight solid cylinder. In some embodiments, the wicking rod comprises at least one bend. In certain embodiments, the wicking rod comprises at least one upward sloped portion, wherein a slope of the at least one upward sloped portion allows a liquid metal to flow from the interior of the crucible toward the tip. In some embodiments, the crucible comprises a front wall that includes the crucible aperture and the wicking rod rests on an inner surface of the crucible, slopes upward and rests on the front wall. In certain embodiments, the first end of the wicking rod is not affixed to the inner surface of the crucible. In some embodiments, the wicking rod rests on an inner surface of the crucible, slopes upward and rests on the porous material.

According to another embodiment, an ion source for generating an ion beam comprising a metal is disclosed. The ion source comprises an arc chamber having an interior for containing a plasma and an extraction aperture for extracting the ion beam; and a crucible having a closed end in communication with the interior of the arc chamber, wherein the crucible comprises a crucible opening on a wall different from the closed end, wherein vapor of the metal exits through the crucible opening and enters the arc chamber. In some embodiments, the crucible opening is disposed on a wall having a lower temperature than the closed end. In certain embodiments, the crucible opening is disposed on a wall opposite the closed end. In some embodiments, the ion source comprises channels in communication with the crucible opening and the interior of the arc chamber such that vapor passes through the channels to the arc chamber. In certain embodiments, the ion source comprises a porous material disposed within an interior of the crucible proximate the crucible opening such that the vapor passes through the porous material before exiting through the crucible opening.

BRIEF DESCRIPTION OF THE FIGURES

For a better understanding of the present disclosure, reference is made to the accompanying drawings, which are incorporated herein by reference and in which.

DETAILED DESCRIPTION

As described above, metal sputter targets may be problematic if the temperature within the arc chamber or other processing chamber exceeds the melting point of the metal. In such instances, the metal sputter target may become molten and drip into the arc chamber, potentially causing damage and reducing the life of the arc chamber.

Further, testing has found that unexpectedly, liquid metals tend to migrate toward the region of maximum temperature. Thus, in certain embodiments, the liquid metal may actually defy gravity to travel toward a hotter region.

Because of this behavior, it is difficult to effectively contain the liquid metal, while at the same time, exposing it to a plasma so that the metal can be ionized.

Figure 1:
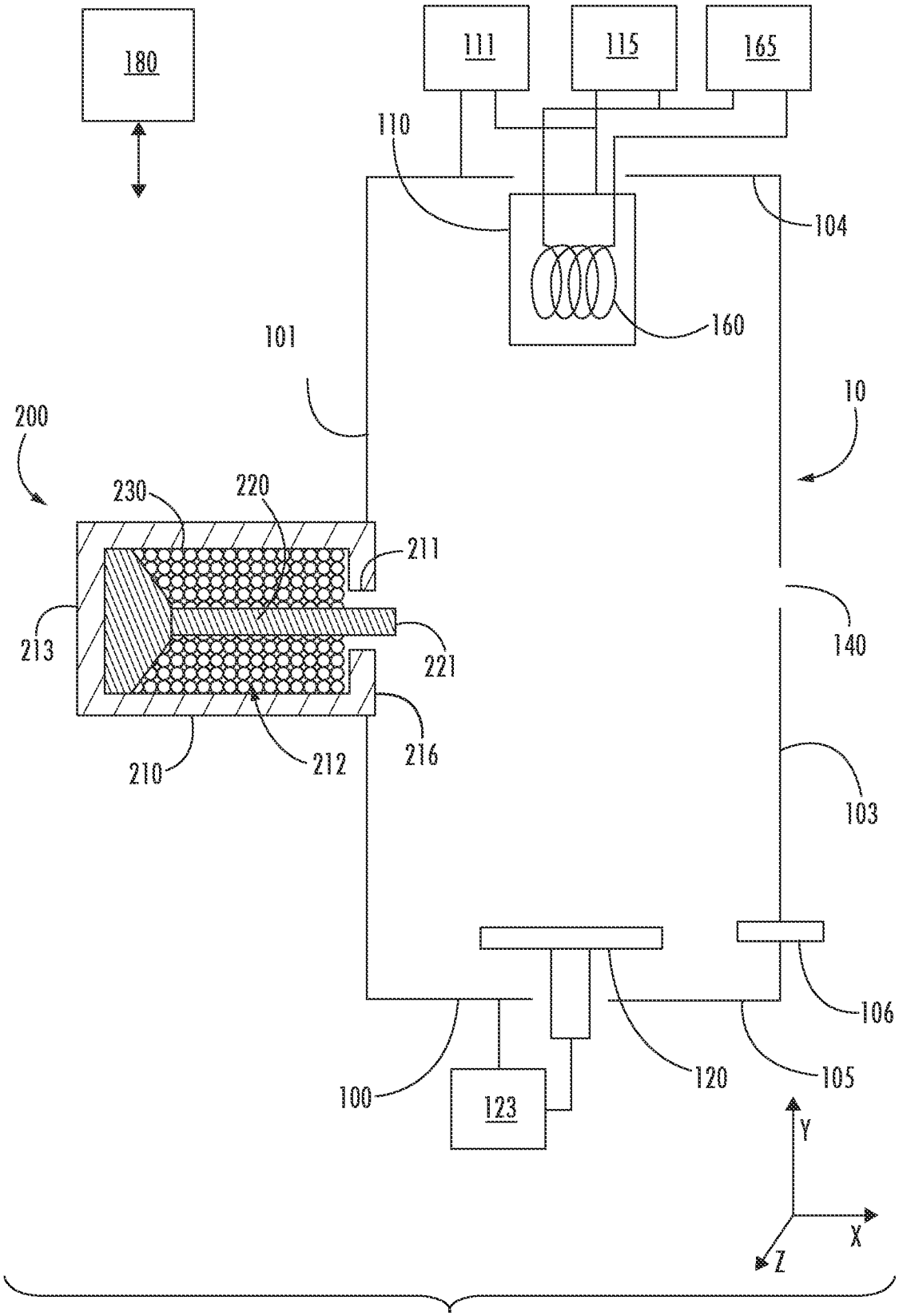
FIG. 1 shows an IHC source with the crucible according to one embodiment.

Thus, in certain embodiments, a crucible may be designed which takes into consideration this behavior. One such crucible is shown in FIG. 1 in conjunction with an indirectly heated cathode (IHC) ion source. Although an IHC ion source is described, it is understood that the crucible may be used in conjunction with a Bernas ion source, a plasma chamber or another ion source.

FIG. 1 shows an ion source that utilizes this crucible. The IHC ion source 10 includes an arc chamber 100, comprising two opposite ends, and walls 101 connecting to these ends. The walls 101 of the arc chamber 100 may be constructed of an electrically conductive material and may be in electrical communication with one another. In some embodiments, a liner may be disposed proximate one or more of the walls 101. The liner may cover an entirety of one or more of the walls 101, such that the one or more walls 101 are not subjected to the harsh environment within the arc chamber 100. A cathode 110 is disposed in the arc chamber 100 at a first end 104 of the arc chamber 100. A filament 160 is disposed behind the cathode 110. The filament 160 is in communication with a filament power supply 165. The filament power supply 165 is configured to pass a current through the filament 160, such that the filament 160 emits thermionic electrons. Cathode bias power supply 115 biases filament 160 negatively relative to the cathode 110, so these thermionic electrons are accelerated from the filament 160 toward the cathode 110 and heat the cathode 110 when they strike the back surface of cathode 110. The cathode bias power supply 115 may bias the filament 160 so that it has a voltage that is between, for example, 200V to 1500V more negative than the voltage of the cathode 110. The cathode 110 then emits thermionic electrons on its front surface into arc chamber 100.

Thus, the filament power supply 165 supplies a current to the filament 160. The cathode bias power supply 115 biases the filament 160 so that it is more negative than the cathode 110, so that electrons are attracted toward the cathode 110 from the filament 160. In certain embodiments, the cathode 110 may be biased relative to the arc chamber 100, such as by an arc power supply 111. In other embodiments, the cathode 110 may be electrically connected to the arc chamber 100, so as to be at the same voltage as the walls 101 of the arc chamber 100. In these embodiments, the arc power supply 111 may not be employed and the cathode 110 may be electrically connected to the walls 101 of the arc chamber 100. In certain embodiments, the arc chamber 100 is connected to electrical ground.

On the second end 105, which is opposite the first end 104, a repeller 120 may be disposed. The repeller 120 may be biased relative to the arc chamber 100 by means of a repeller bias power supply 123. In other embodiments, the repeller 120 may be electrically connected to the arc chamber 100, so as to be at the same voltage as the walls 101 of the arc chamber 100. In these embodiments, repeller bias power supply 123 may not be employed and the repeller 120 may be electrically connected to the walls 101 of the arc chamber 100. In still other embodiments, a repeller 120 is not employed.

The cathode 110 and the repeller 120 are each made of an electrically conductive material, such as a metal or graphite.

In certain embodiments, a magnetic field is generated in the arc chamber 100. This magnetic field is intended to confine the electrons along one direction. The magnetic field typically runs parallel to the walls 101 from the first end 104 to the second end 105. For example, electrons may be confined in a column that is parallel to the direction from the cathode 110 to the repeller 120 (i.e. the y direction). Thus, electrons do not experience any electromagnetic force to move in the y direction. However, movement of the electrons in other directions may experience an electromagnetic force.

Disposed on one side of the arc chamber 100, referred to as the extraction plate 103, may be an extraction aperture 140. In FIG. 1, the extraction aperture 140 is disposed on a side that is parallel to the Y-Z plane (perpendicular to the page). Further, the IHC ion source 10 also comprises a gas inlet 106 through which a source gas to be ionized may be introduced to the arc chamber 100.

A controller 180 may be in communication with one or more of the power supplies such that the voltage or current supplied by these power supplies may be modified. The controller 180 may include a processing unit, such as a microcontroller, a personal computer, a special purpose controller, or another suitable processing unit. The controller 180 may also include a non-transitory storage element, such as a semiconductor memory, a magnetic memory, or another suitable memory. This non-transitory storage element may contain instructions and other data that allows the controller 180 to perform the functions described herein.

The IHC ion source 10 also includes a crucible 200. The crucible 200 may protrude into the arc chamber 100 through one of the walls 101. This may be the wall 101 opposite the extraction aperture 140, as shown in FIG. 1, or may be a different wall 101.

The crucible 200 comprises outer walls 210. These outer walls 210 may be made of a material that is relatively unaffected by the plasma generated in the IHC ion source 10. Further, the material used for the outer walls 210 may be compatible with the thermal environment, and the liquid metal. For example, in one embodiment, the outer walls 210 may be graphite. These outer walls 210 define a cavity 212 into which the metal to be ionized is disposed. In some embodiments, the cavity 212 may have an inner diameter of 1 inch or less. In certain embodiments, the length of the cavity 212 may be 1 inch or more. However, other dimensions may also be utilized. The crucible may be cylindrical, may be in the form of a rectangular prism or may have a different shape. Furthermore, the front wall 216 of the crucible 200 includes a crucible aperture 211. In this embodiment, this crucible aperture 211 allows the cavity 212 to be in direct communication with the interior of the IHC ion source 10. In other words, the end of the crucible with the crucible aperture 211 may define a portion of one of the walls 101 of the IHC ion source 10.

A wicking rod 220 is disposed within the cavity 212. In certain embodiments, the wicking rod 220 may be affixed to the back wall 213 of the crucible 200, opposite the wall containing the crucible aperture 211. It may also be unaffixed in the crucible 200 and held in place by gravity. The wicking rod 220 may be made from graphite or tungsten. Other materials such as carbides and nitrides may also be used. In the embodiment shown in FIG. 1, the wicking rod 220 is a straight solid cylindrical structure. However, in other embodiments, explained below, the wicking rod 220 may have a different shape. The length of the wicking rod 220 may be longer than the depth of the cavity 212 such that the tip 221 of the wicking rod 220 may extend beyond the crucible 200 and into the IHC ion source 10. The diameter of the wicking rod 220 may be adjusted based on the application and the desired flow rate of liquid metal. In certain embodiments, larger diameters may result in higher flow rates.

A dopant material 230, such as a metal, is disposed in the cavity 212. In one embodiment, the dopant material 230 is a solid metal, such as aluminum, gallium, lanthanum or indium. This solid material may be extruded in the form of a wire and wound onto the wicking rod 220. In other embodiments, the solid material may be in the form of beads or a hollow cylinder that is fitted around the wicking rod 220.

During operation, the filament power supply 165 passes a current through the filament 160, which causes the filament 160 to emit thermionic electrons. These electrons strike the back surface of the cathode 110, which may be more positive than the filament 160, causing the cathode 110 to heat, which in turn causes the cathode 110 to emit electrons into the arc chamber 100. These electrons collide with the molecules of source gas that are fed into the arc chamber 100 through the gas inlet 106. The source gas may be a carrier gas, such as argon, or an etching gas, such as $BF_3$ or other halogen species. The combination of electrons from the cathode 110, the source gas and the positive potential creates a plasma. In certain embodiments, the electrons and positive ions may be somewhat confined by a magnetic field. In certain embodiments, the plasma is confined near the center of the arc chamber 100, proximate the extraction aperture 140. This plasma heats the tip 221 of the wicking rod 220, which serves to melt the dopant material 230 in the cavity 212. Since the tip 221 of the wicking rod 220 is at the highest temperature, the dopant material 230, after melting, tends to flow toward the tip 221. Since the tip 221 is disposed in the IHC ion source 10, chemical etching or sputtering by the plasma transforms the dopant material 230 into the gas phase and causes ionization. The ionized feed material can then be extracted through the extraction aperture 140 and used to create an ion beam.

In certain embodiments, the thermal conductivity between the wicking rod 220 and the back wall 213 may be increased. For example, the cross-sectional area of the wicking rod 220 may be smaller near the back wall 213. This is done to ensure that the tip 221 is the hottest point and that the dopant material 230 flows outward through the crucible aperture 211.

Figure 2A:
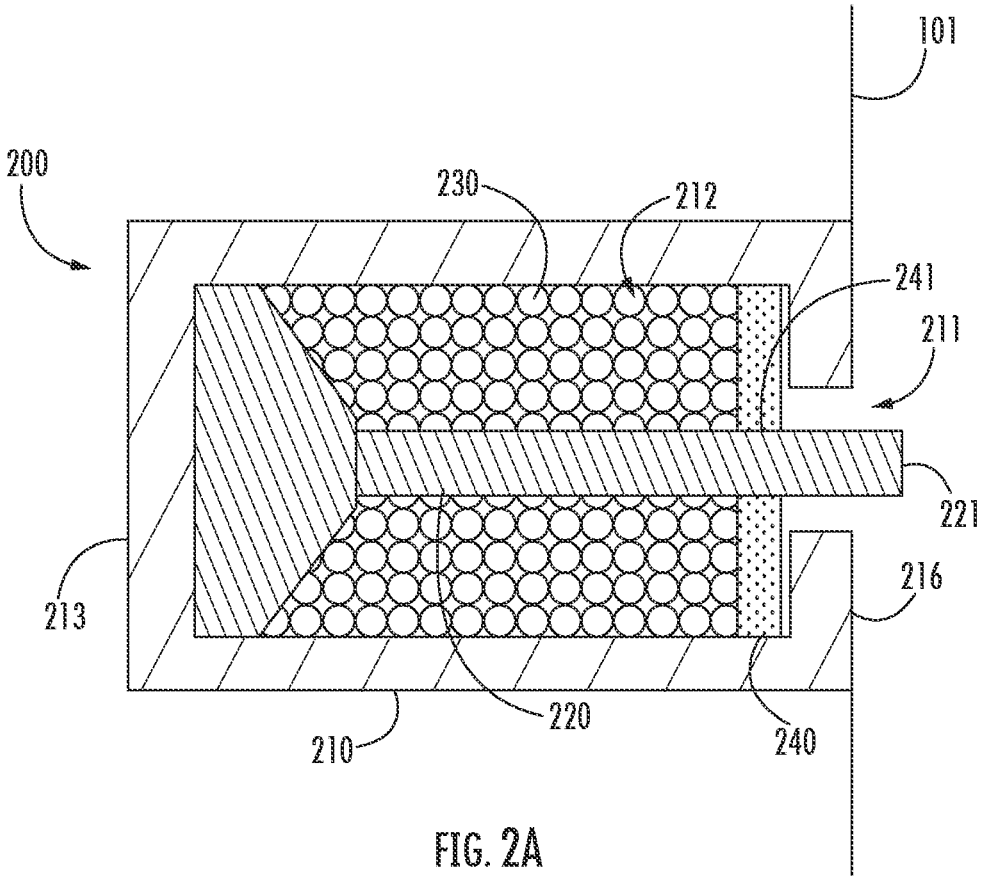
FIG. 2A shows the crucible according to a second embodiment.

While FIG. 1 shows one example of a crucible, other variations are also possible. For example, as shown in FIG. 2A, a porous material 240 may be included in the cavity 212 to contain the dopant material 230. This porous material 240 may be dimensioned such that it has the same outer dimensions as the inner dimensions of the cavity 212. Further, the porous material 240 may have a hole 241 that passes through it. The porous material 240 may be positioned such that the porous material 240 is disposed between the dopant material 230 and the crucible aperture 211. The wicking rod 220 may pass through the hole 241 in the porous material 240. In this way, the porous material 240 retains the dopant material 230 within the cavity 212, while allowing melted material to flow along the wicking rod 220 toward the tip 221. As with FIG. 1, the tip 221 may extend into the arc chamber 100 of the IHC ion source 10.

Figure 2B:
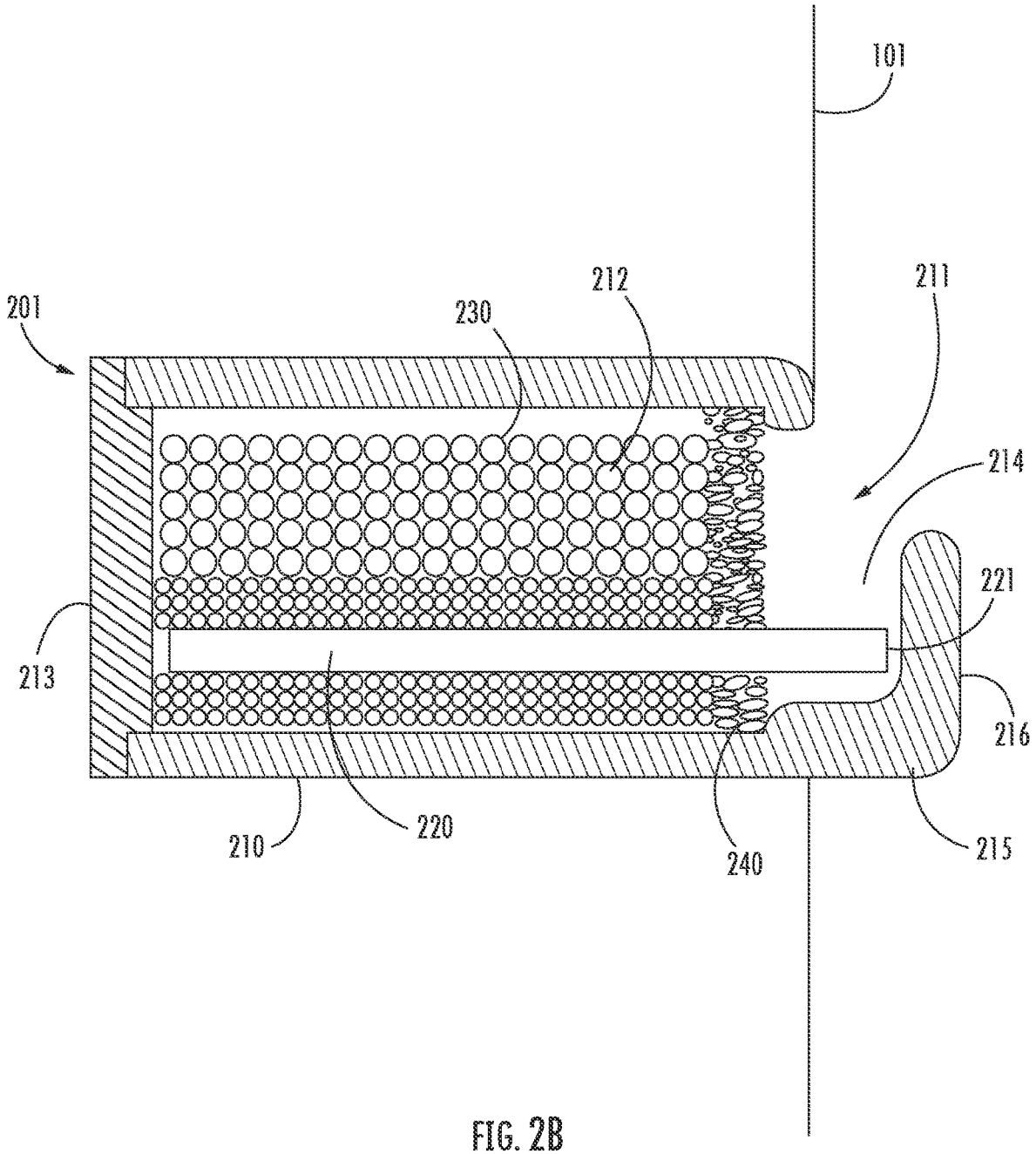
FIG. 2B shows the crucible according to a third embodiment.

FIG. 2B shows a variation of the crucible 200 shown in FIG. 2A. In this embodiment, the crucible 201 supports the wicking rod 220 at a position closer to the bottom of the crucible 201. For example, FIGS. 1 and 2A show the wicking rod 220 disposed at or near in the center of the crucible 200 and attached to the back wall 213. This embodiment may allow greater utilization of the dopant material 230 disposed in the cavity 212. A porous material 240 having a hole 241 is also disposed in the cavity 212. In this embodiment, the outer walls 210 may be formed so to the bottom portion 215 of the outer walls 210 extends outward more than the top portion of the outer walls 210 and includes a front wall 216, so as to create an open receptacle 214 with a crucible aperture 211 that is adapted to hold any molten material that drops from the wicking rod 220. In certain embodiments, the bottom portion 215 of the outer walls 210 extends beyond the wall 101 of the IHC ion source 10. The wicking rod 220 may extend into the volume defined by this open receptacle 214, also within the volume defined by the walls 101.

Note that this figure shows the dopant material 230 configured as wire wound on the wicking rod 220, and as beads disposed above the wire. However, the dopant material 230 may take any shape or plurality of shapes.

Further, FIGS. 1, 2A-2B show the wicking rod 220 as being parallel to the major axis of the crucible and perpendicular to the wall 101 of the IHC ion source 10. However, other variations are possible. For example, the wicking rod 220 may be attached to the back wall 213 near the bottom of the crucible and slope upward as it moves toward the crucible aperture 211. This slope may be set so as to allow the liquid metal to flow upward along the wicking rod 220 toward the tip 221.

Figure 2C:
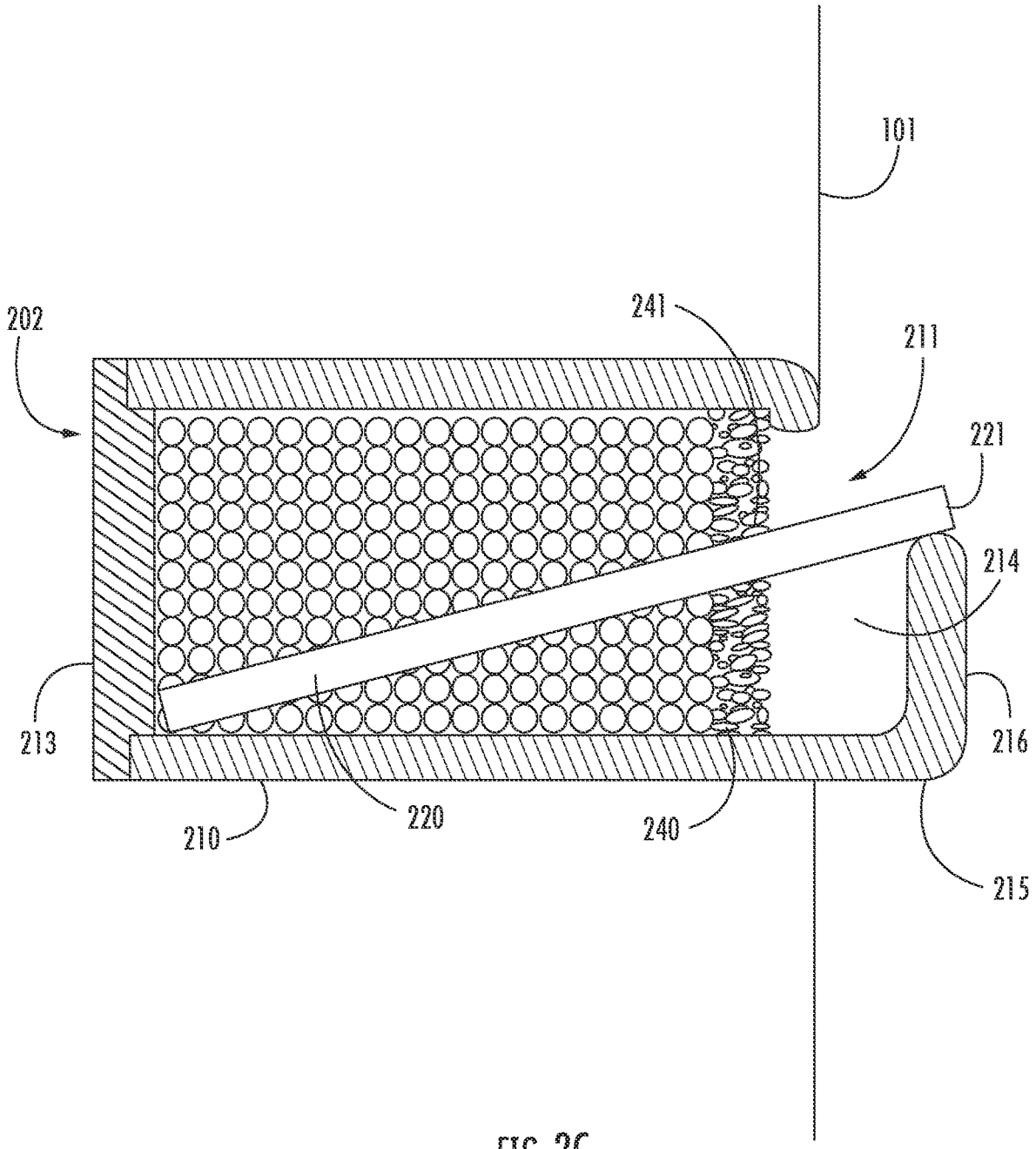
FIG. 2C shows the crucible according to a fourth embodiment.

In another embodiment, shown in FIG. 2C, the wicking rod 220 may not be directly affixed to the outer walls 210 of the crucible 202, but rather remain unattached within the cavity 212 of the crucible 202 and may be held in place by gravity. This allows the tip 221 of the wicking rod 220 to become hotter since it is no longer thermally sunk to the back wall 213 directly. If the crucible aperture 211 of the crucible 202 is near the top of the crucible 202, this will also allow the wicking rod 220 to naturally position itself on an upward slope. Thus, the wicking rod 220 rests on an inner surface of the crucible 202, slopes upward passing through the crucible aperture 211, and rests on the front wall 216. In certain embodiments, the wicking rod 220 is not affixed to the inner surface. A porous material 240 having a hole 241 is also disposed in the cavity 212. As was described with FIG. 2B, in this embodiment, the outer walls 210 may be formed so to the bottom portion 215 of the outer walls 210 extends outward more than the top portion of the outer walls 210, so as to create an open receptacle 214 with a crucible aperture 211. In certain embodiments, the bottom portion 215 of the outer walls 210 extends beyond the wall 101 of the IHC ion source 10. The wicking rod 220 may extend into the volume defined by this open receptacle 214 and rest on the front wall 216 of the crucible 202.

In another embodiment, the hole 241 in the porous material 240 may be positioned so that the wicking rod 220 is supported by the inner surface of the crucible 202 and the porous material 240 and does not contact the front wall 216.

While FIG. 2C shows that the crucible 202 includes a bottom portion 215 that extends further than the rest of the outer walls 210, the embodiment is not limited to this embodiment. For example, the crucible shown in FIG. 2A may be utilized with the sloped wicking rod 220 shown in FIG. 2C, wherein the crucible aperture 211 may be located near the top of the front wall 216 such that the wicking rod 220 slopes upward and rests on the front wall 216.

Furthermore, in another embodiment, the wicking rod 220 may be affixed to an inner surface of the crucible 202 and slope upward toward the crucible aperture 211 and extend into the IHC ion source 10. In one embodiment, the wicking rod 220 may rest on the front wall 216, as shown in FIG. 2C. However, in other embodiments, the wicking rod 220 may be separated from the front wall 216, similar to the embodiment shown in FIG. 2A.

Figure 2D:
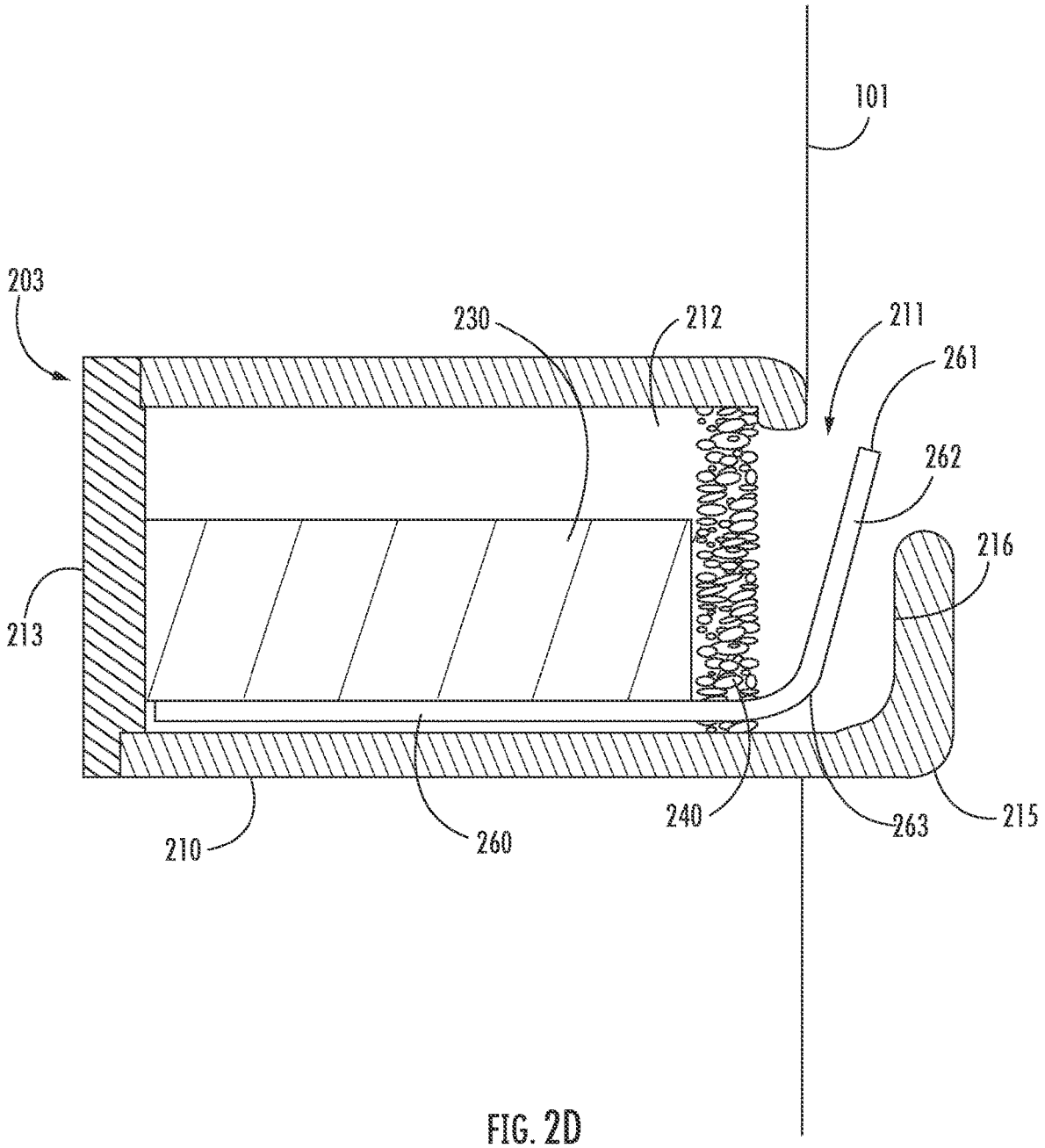
FIG. 2D shows the crucible according to a fifth embodiment.

FIG. 2D shows another embodiment of a crucible 203. In this embodiment, the outer walls 210 may be as described with respect to FIG. 2B. However, in this embodiment, the wicking rod 260 is not a straight cylinder, rather, the wicking rod 260 may have a bend 263 in it. For example, the wicking rod 260 may be disposed close to the bottom of the crucible 202, but may slope upward after passing through the hole 241 in the porous material 240. This upward slope 262 allows the tip 221 of the wicking rod 220 to become hotter, increasing the thermal gradient. This upward slope 262 may be at an angle that allows the liquid metal to flow upward toward the tip 261.

Of course, the wicking rod may take any suitable shape such that it contacts the dopant material 230 and has a tip that is disposed in or near the IHC ion source 10.

Further, the flow rate of the liquid metal along the wicking rod may be controlled by varying one or more of the following parameters of the wicking rod: diameter, length, shape, finish, material and porosity. For example, a larger diameter may support a higher rate flow of liquid material, as there is more surface area on the wicking rod 220. Additionally, a textured finish may slow the flow rate of the liquid material as compared to a smooth finish.

Further, the cross section of the wicking rod 220 may vary over its length. For example, a taper at the tip 221 may be used to limit the amount of liquid material that is able to flow into the arc chamber 100 and thus control the vaporization rate of the liquid material.

Thus, in each of these embodiments, the crucible is designed to take advantage of the observation that the liquid metal flows toward the hottest region, even flowing against gravity to do so. Thus, the dopant material 230 is disposed in a cavity, wherein there is a pathway to the interior of the IHC ion source 10 wherein the temperature along that pathway may be continuously increasing such that the liquid material follows the pathway. Further, the pathway may be designed such that the amount of material that is able to flow through that pathway. In other words, the flow rate through the pathway may be controlled. This allows better control of the rate of ionization and may also reduce the possibility to spillage.

While a wicking rod may be used to achieve these goals, other techniques that provide a pathway wherein the temperature is continuously increasing may also be used. For example, a hollow rod or tube may be routed such that the temperature gradient is increasing and the dopant material 230 travels through the interior of the rod.

The observation that liquid metal tends to flow to hotter regions may be used in other ways as well. For example, while FIGS. 1 and 2A-2D utilize this observation to draw the liquid metal into the IHC ion source 10, other embodiments are also possible.

Figure 3:
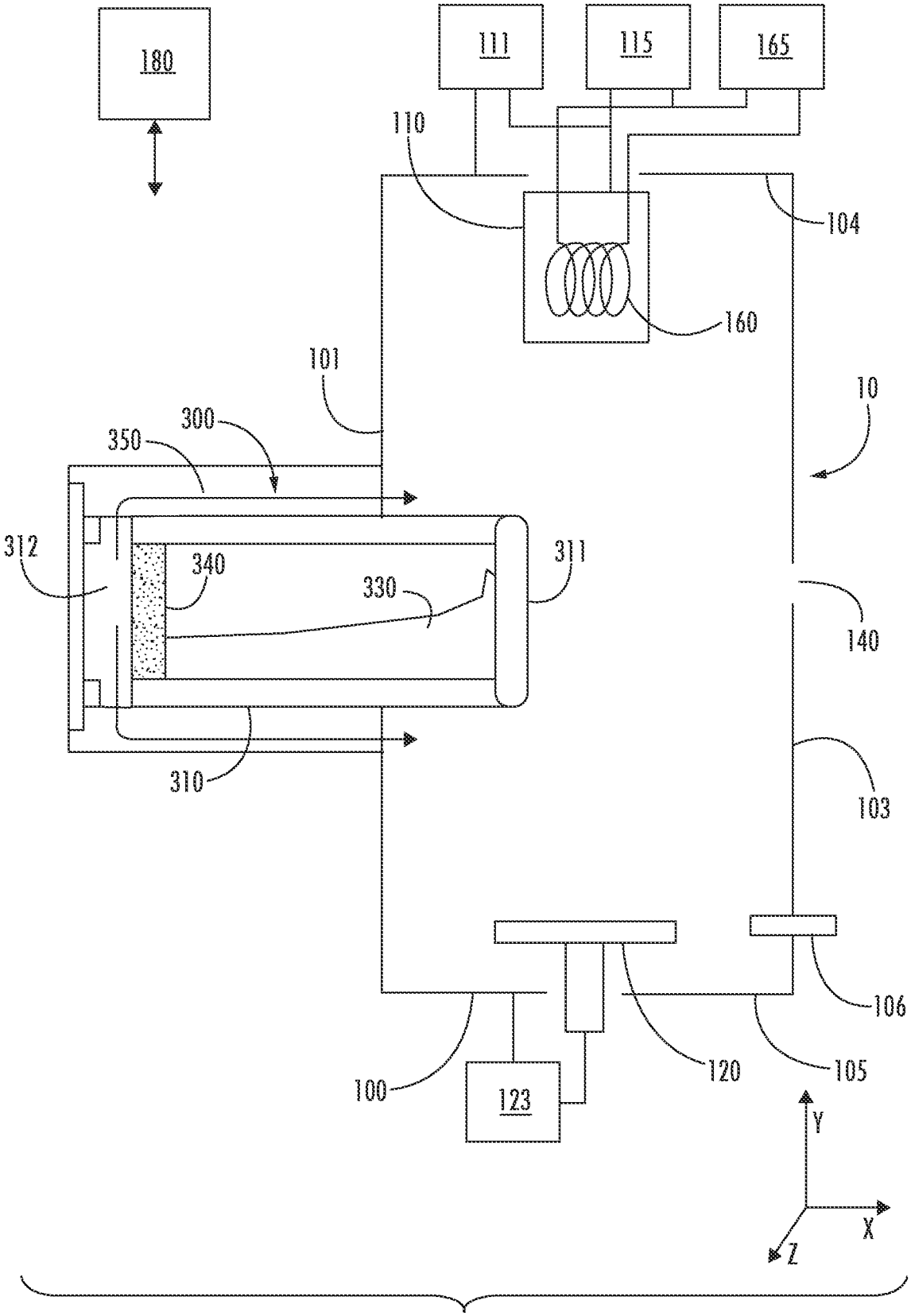
FIG. 3 shows an inverted crucible according to one embodiment.

FIG. 3 shows an inverted crucible 300. In this embodiment, the inverted crucible 300 is positioned such that a closed end 311 is disposed in the IHC ion source 10. The IHC ion source 10 is as described above.

In this way, since the closed end 311 is in communication with the interior of the arc chamber 100 of the IHC ion source 10, the closed end 311 may be the hottest surface. Thus, the dopant material 330 will tend to flow toward the closed end 311. Since this closed end 311 does not contain an opening, spillage is avoided. However, the heat from the closed end 311 may cause the dopant material 330 to vaporize. This vapor is then free to exit via the crucible opening 312 at a cooler end of the inverted crucible 300. The crucible opening 312 may be disposed on a wall that is at a lower temperature than the closed end 311 such that the dopant material 330 is not drawn toward the crucible opening 312. In some embodiments, as shown in FIG. 3, the crucible opening 312 is opposite the closed end 311. However, in other embodiments, the crucible opening 312 may be on a different wall 310, such as the top wall. Further, a porous material 340 may be disposed proximate the crucible opening 312. The porous material 340 may be disposed between the crucible opening 312 and the dopant material 330 to minimize the flow of liquid materials from the inverted crucible 300. Further, channels 350 may lead from the crucible opening 312 to the IHC ion source 10 such that the vapor may flow into the arc chamber 100. In certain embodiments, the channels 350 are on the exterior of the inverted crucible 300. Thus, in the embodiment, the closed end 311 serves to draw the liquid away from the crucible opening 312 so that vapor can exit the inverted crucible 300, but liquid material is not drawn to the crucible opening 312.

While an IHC ion source is disclosed in FIG. 1, it is understood that any of the crucibles described in the figures may be utilized with any ion source that has an interior for containing a plasma and having an extraction aperture. For example, the ion source may be a plasma chamber, a Bernas source or another type of ion source.

The embodiments described above in the present application may have many advantages. First, the present system allows a solid metal material to be used as a dopant material without the issues associated with the prior art.

Specifically, in certain embodiments, a pathway is created from the cavity that holds the dopant material to the IHC ion source 10, wherein the temperature is continuously increasing along that pathway. Because liquid metal tends to flow toward the hottest region, the liquid material is drawn toward the IHC ion source. However, by proper design of this pathway, the flow rate of liquid material toward the IHC ion source may be controlled, thus controlling the ionization rate and minimizing the possibility of spillage.

In other embodiments, the cavity containing the dopant material may have one end that is maintained at the highest temperature, so as to attract the liquid. This serves to divert the liquid away from the opening, which is on a different end of the crucible. In this way, vapor is able to escape through the opening while minimizing the possibility that liquid exits through the opening.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. An ion source for generating an ion beam comprising a metal, comprising:

an arc chamber having an interior for containing a plasma and an extraction aperture for extracting the ion beam; and a crucible having a crucible aperture in communication with the interior of the arc chamber for holding the metal, wherein the crucible comprises a pathway from an interior of the crucible toward the interior of the arc chamber along which liquid metal travels, wherein a temperature is continuously increasing along the pathway.

2. The ion source of claim 1, wherein the pathway extends into the interior of the arc chamber.

3. The ion source of claim 1, wherein the metal comprises aluminum, gallium, lanthanum or indium.

4. The ion source of claim 1, wherein the pathway comprises a wicking rod, having a first end disposed in the interior of the crucible and a tip proximate the crucible aperture.

5. The ion source of claim 1, wherein the pathway comprises a hollow tube.

6. An ion source for generating an ion beam comprising a metal, comprising:

an arc chamber having an interior for containing a plasma and an extraction aperture for extracting the ion beam;

a crucible having a crucible aperture in communication with the interior of the arc chamber; and a wicking rod, having a first end disposed in an interior of the crucible and a tip proximate the crucible aperture.

7. The ion source of claim 6, wherein the tip extends beyond the crucible aperture and into the interior of the arc chamber.

8. The ion source of claim 6, wherein the first end of the wicking rod is affixed to a back wall of the crucible.

9. The ion source of claim 6, further comprising a porous material disposed in the interior of the crucible and before the crucible aperture, wherein the porous material has an opening through which the wicking rod passes.

10. The ion source of claim 9, wherein the wicking rod rests on an inner surface of the crucible, slopes upward and rests on the porous material.

11. The ion source of claim 6, wherein the wicking rod comprises a straight solid cylinder.

12. The ion source of claim 6, wherein the wicking rod comprises at least one bend.

13. The ion source of claim 6, wherein the wicking rod comprises at least one upward sloped portion, wherein a slope of the at least one upward sloped portion allows a liquid metal to flow from the interior of the crucible toward the tip.

14. The ion source of claim 6, wherein the crucible comprises a front wall that includes the crucible aperture and the wicking rod rests on an inner surface of the crucible, slopes upward and rests on the front wall.

15. The ion source of claim 14, wherein the first end of the wicking rod is not affixed to the inner surface of the crucible.

16. An ion source for generating an ion beam comprising a metal, comprising:

an arc chamber having an interior for containing a plasma and an extraction aperture for extracting the ion beam; and a crucible having a closed end in communication with the interior of the arc chamber, wherein the crucible comprises a crucible opening on a wall different from the closed end, wherein vapor of the metal exits through the crucible opening and enters the arc chamber.

17. The ion source of claim 16, wherein the crucible opening is disposed on a wall having a lower temperature than the closed end.

18. The ion source of claim 17, wherein the crucible opening is disposed on a wall opposite the closed end.

19. The ion source of claim 16, further comprising channels in communication with the crucible opening and the interior of the arc chamber such that vapor passes through the channels to the arc chamber.

20. The ion source of claim 16, further comprising a porous material disposed within an interior of the crucible proximate the crucible opening such that the vapor passes through the porous material before exiting through the crucible opening.

* * * * *